US010977908B2

(12) United States Patent
Philippi

(10) Patent No.: US 10,977,908 B2
(45) Date of Patent: Apr. 13, 2021

(54) PROXIMITY ALERT SYSTEM

(71) Applicant: Ricky Philippi, Fort Worth, TX (US)

(72) Inventor: Ricky Philippi, Fort Worth, TX (US)

( * ) Notice: Subject to any disclaimer, the term of this patent is extended or adjusted under 35 U.S.C. 154(b) by 243 days.

(21) Appl. No.: 16/205,738

(22) Filed: Nov. 30, 2018

(65) Prior Publication Data

US 2019/0164391 A1 May 30, 2019

Related U.S. Application Data

(60) Provisional application No. 62/592,759, filed on Nov. 30, 2017.

(51) Int. Cl.
*G08B 3/06* (2006.01)
*G08B 13/10* (2006.01)

(52) U.S. Cl.
CPC ..... *G08B 3/06* (2013.01); *G08B 13/10* (2013.01)

(58) Field of Classification Search
CPC ..... G08B 3/06; G08B 13/10
USPC ..... 116/139
See application file for complete search history.

(56) References Cited

U.S. PATENT DOCUMENTS 3,725,886 A * 4/1973 Marks ..... G08B 13/00 340/539.26
4,401,896 A 8/1983 Fowler et al.
5,057,819 A * 10/1991 Valenti ..... A47D 15/001 340/573.1
5,142,109 A 8/1992 O'Meara, Jr. et al.
5,210,528 A 5/1993 Schulman et al.
8,094,013 B1 * 1/2012 Lee ..... A61B 5/1135 340/539.15
8,966,997 B2 * 3/2015 Taylor ..... G01L 1/146 73/862.044
2005/0083207 A1 * 4/2005 Smith ..... A61F 5/3776 340/668
2007/0068741 A1 3/2007 Janos et al.
2009/0192364 A1 * 7/2009 Voto ..... G08B 21/22 600/301
2009/0195393 A1 * 8/2009 Tegeler ..... G08B 13/10 340/573.3
2010/0277328 A1 * 11/2010 Mullan ..... G08B 29/185 340/665
2011/0068928 A1 * 3/2011 Riley ..... A61B 5/02055 340/573.1
2011/0068932 A1 * 3/2011 Flocard ..... A61B 5/6891 340/573.4
2012/0025991 A1 * 2/2012 O'Keefe ..... H05B 47/105 340/573.4
2015/0279189 A1 * 10/2015 Keene ..... G08B 21/18 340/540
2016/0078740 A1 * 3/2016 Pirio ..... A61G 7/005 340/573.4
2016/0098911 A1 * 4/2016 Murphy ..... G08B 21/0261 340/573.4

* cited by examiner

*Primary Examiner* — Kerri L Mcnally
(74) *Attorney, Agent, or Firm* — Richard Eldredge; Leavitt Eldredge Law Firm

(57) ABSTRACT

A proximity alert system creates an audible warning when a child or pet applies force to mat that is positioned near a hazard or other protected area. A bladder, when squeezed discharges air through a horn to create the warning. The bladder is enclosed in a durable outer covering.

2 Claims, 4 Drawing Sheets

PROXIMITY ALERT SYSTEM

BACKGROUND

1. Field of the Invention

The present invention relates generally to child protective systems, and more specifically, to a system for causing an alert when a child, pet or other individual comes close to a hazardous area or object.

2. Description of Related Art

Child protective systems are well known in the art and are effective means to prevent harm to a child from household threats such as chemicals. For example, FIG. 1 depicts a conventional door latch system 101 having a door 103 that closes a cupboard 105, the door having a latch 107 that attaches to a frame 109 and can be opened by pulling up on the latch 107 from the inside.

One of the problems commonly associated with system 101 is limited use. For example, a child is able to pull on the door 103 and place their fingers in the opening and if unattended for a period of time open the door by chance allowing the child access to what is stored in the cupboard 105.

Accordingly, although great strides have been made in the area of child protective systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
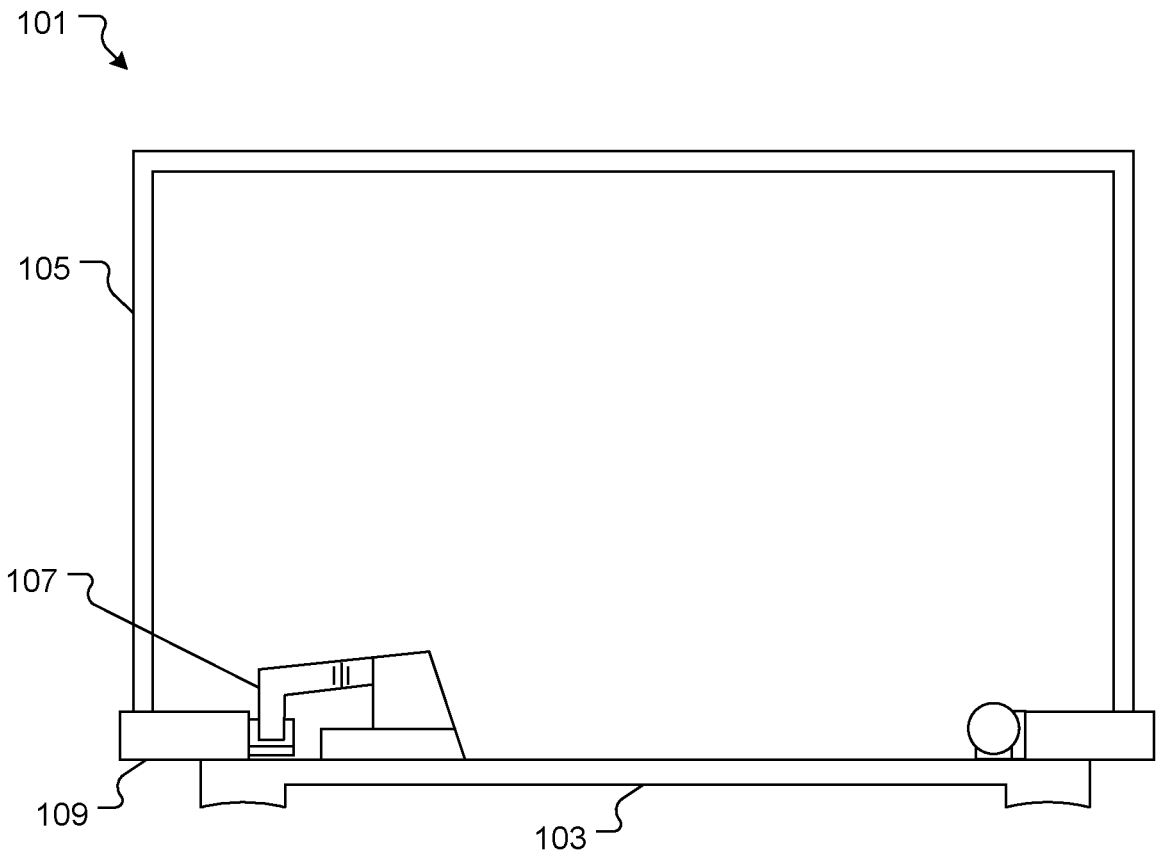
FIG. 1 (Prior Art)
FIG. 1 is a top view of a common door latch system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional door latch systems. Specifically, the invention of the present application creates an audible alert to notify a caregiver that the child is near a selected location. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
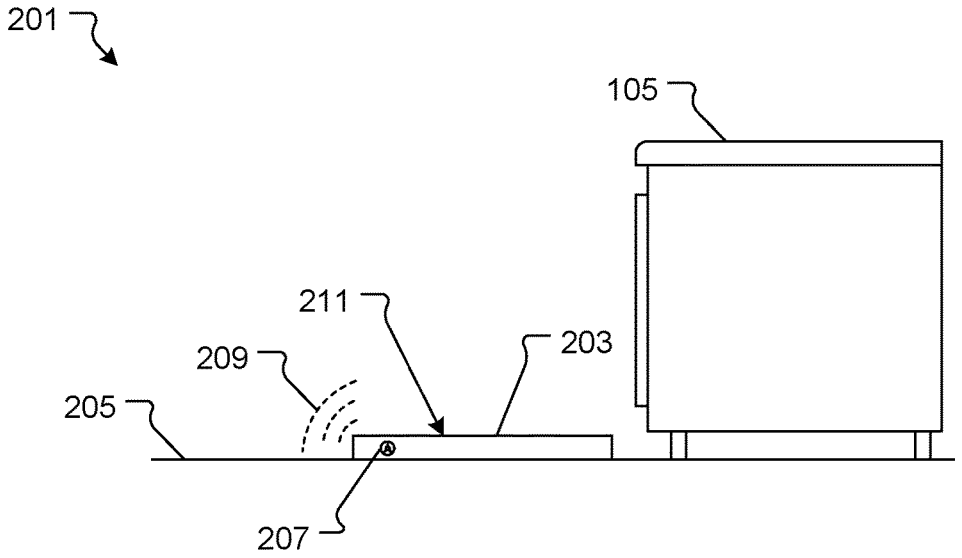
FIG. 2 is a side view of a proximity alert system in accordance with a preferred embodiment of the present application.

Referring now to the drawings wherein like reference characters identify corresponding or similar elements throughout the several views, FIG. 2 depicts a side view of a proximity alert system in accordance with a preferred embodiment of the present application. It will be appreciated that system 201 overcomes one or more of the above-listed problems commonly associated with conventional child protective systems.

In the contemplated embodiment, system 201 includes an alert mat 203 placed on the floor 205 in front of a cupboard 105. The alert mat 203 having a horn 207 configured to sound 209 when pressure is applied to the top surface 211 of the mat 203.

Figure 3:
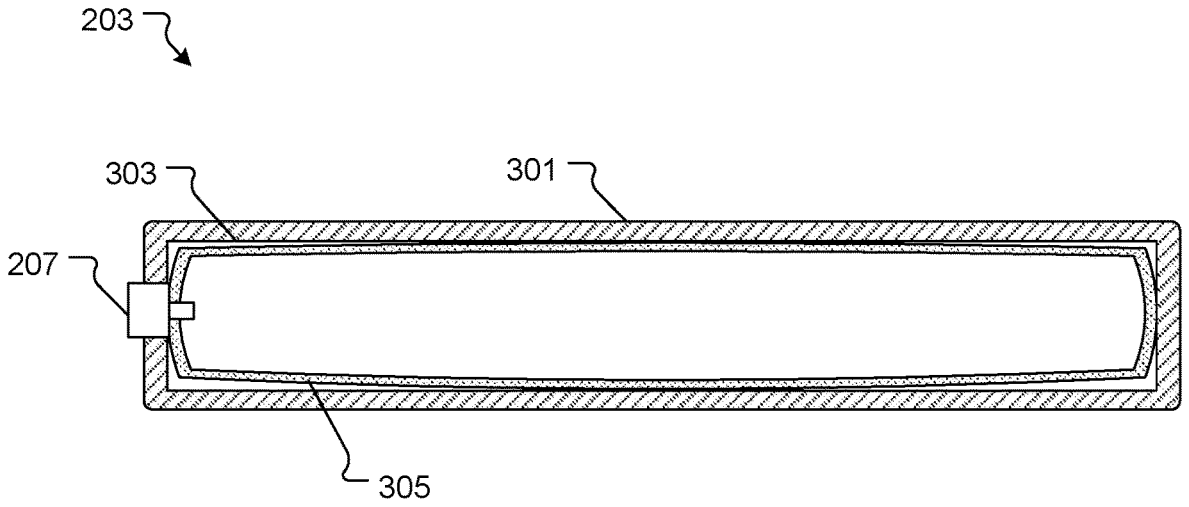
FIG. 3 is a cross-sectional side view of the alert mat of FIG. 2.

Referring now to FIG. 3 the preferred embodiment of alert mat 203 is depicted. Embodiment 203 including a body 301 enclosing a space 303 wherein a fluid bladder 305 is attached. The bladder 305 being in fluid communication with the horn 207.

It should be appreciated that one of the unique features believed characteristic of the present application is that the system does not require power allowing it to be placed in any location where there is sufficient space for it to lay on the floor.

Figure 4:
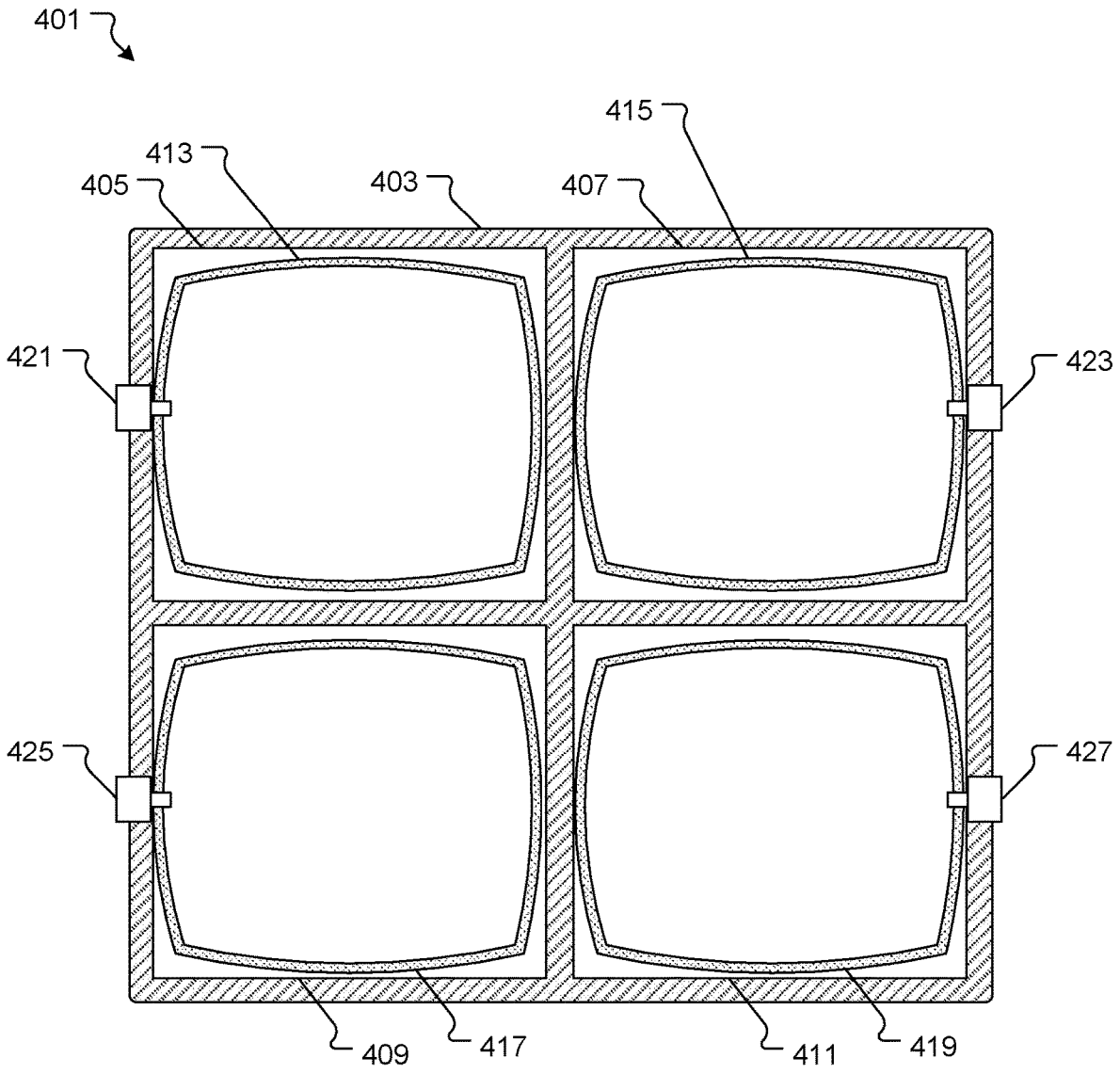
FIG. 4 is a cross-sectional top view of an alternative embodiment of the alert mat of FIG. 2.

Referring now to FIG. 4 an alternative embodiment of the alert mat 203 is depicted. Embodiment 401 including body 403 enclosing spaces 405, 407, 409, 411 each having a fluid bladder 413, 415, 417, 419 respectively attached therein. The bladders, 413, 415, 417, 419 being in fluid communication with a horn 421, 423, 425, 427.

It will be appreciated that in this embodiment 401 that a different horn 419, 421, 423, 425 will sound dependent on where pressure is applied to the mat 401.

Figure 5:
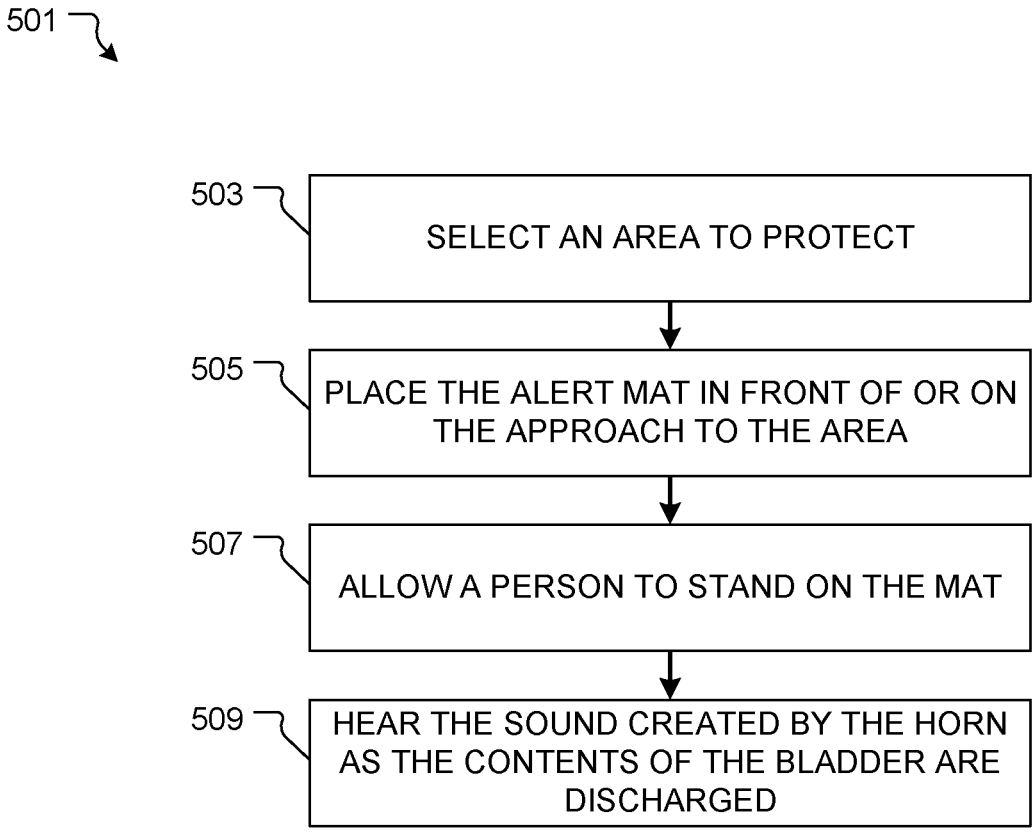
FIG. 5 is a flowchart of the preferred method of use of the system of FIG. 2.

Referring now to FIG. 5 the preferred method of use of the system 201 is depicted. Method 501 including selecting an area to protect 503, placing the alert mat in front of or on the approach to the area 505, allowing a person or pet to stand on the mat 507 and hearing the sound created by the horn as the contents of the bladder are discharged 509.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A proximity alert system comprising:

a body enclosing at least one space;

at least one bladder configured to hold a fluid is attached in the space; and at least one horn in fluid communication with the bladder;

wherein the body is located by or on the approach to a hazardous area; and wherein when pressure is applied to the body the fluid in the bladder passes through the horn creating an audible warning.

2. The system of claim 1 wherein the body encloses two or more spaces, each space having a bladder and horn therein.

* * * * *